United States Patent [19]

Pelletier

[11] 4,323,449

[45] Apr. 6, 1982

[54] METHOD AND APPARATUS FOR BENEFICIATING COAL

[76] Inventor: Robert A. Pelletier, Rte. 15, Moreland Dr., Kingsport, Tenn. 37660

[21] Appl. No.: 206,961

[22] Filed: Nov. 14, 1980

[51] Int. Cl.[3] ..... B03B 5/02; B03B 5/30

[52] U.S. Cl. ..... 209/17; 209/44; 209/172.5; 209/452

[58] Field of Search ..... 209/44, 172.5, 452, 209/451, 445, 473, 482, 155, 152, 290, 297, 279, 280, 13, 18, 17

[56] References Cited

U.S. PATENT DOCUMENTS

| | | | |
|---|---|---|---|
| 299,337 | 5/1884 | Brotherhood | 209/44 |
| 3,970,547 | 7/1976 | Theodore et al. | 209/152 X |
| 4,083,776 | 4/1978 | Shimoiizaka | 209/452 |
| 4,159,242 | 6/1979 | Walker | 209/44 |
| 4,203,831 | 5/1980 | Parnaby | 209/13 |

*Primary Examiner*—Ralph J. Hill

*Attorney, Agent, or Firm*—Luedeka & Fitch

[57] ABSTRACT

A method and apparatus for beneficiating a mixture of coal and a denser material are provided. The coal and ash mixture and a liquid medium are deposited into a rotating, sloping barrel having internal spiral flights and foraminous end sections. Coal and medium travel downwardly and the denser material is screwed upwardly. The positions of deposit of the mixture and the medium are adjustable, as are the rates of rotation of the barrel and the angle of the barrel.

11 Claims, 5 Drawing Figures

METHOD AND APPARATUS FOR BENEFICIATING COAL

The present invention relates generally to the beneficiation of a mixture of coal and ash and more particularly to the beneficiation of varying mixtures of coal and ash.

Coal has been used as an energy source for centuries. It was first mined on a large scale as a power source for the steam engines in early industrial plants. In the early days of coal mining, large seams of relatively pure coal were readily available. The coal was graded by hand and the rock, dirt and smaller pieces of coal were merely dumped into large piles known as gob piles. The easy availability of pure coal created an economic situation in which substantial quantities of coal accumulated in the gob piles.

A large number of coal mines are located in mountainous regions. Gob piles are generally located close to the mines to minimize transportation expenses and often contain millions of tons of material. Because of this location on mountains and the manner in which they are built, i.e., dumping, the gob piles are highly unstable as well as unsightly. Large rains create serious erosion problems, often causing mud slides which wash out roads and homes. Even without heavy rains, streams passing through and around gob piles are fouled by the runoff from the piles.

As the needs for energy increased with progressive industrialization, the large, high-purity coal seams were depleted. What were left were narrow seams and seams which contain lower concentrations of coal and more rock, soil and other non-combustible material, collectively known as ash. Much of this remaining coal is mined today by the method known as strip mining, in which the soil, known as the overburden, is removed from over an entire seam of coal. Then large power shovels are used to dig out the coal. Substantial quantities of excess ash are frequently mixed with the coal in this process of removal.

The desirability and price of coal depends upon the amount of non-combustible ash mixed with the coal. Generally, coal containing less ash is more valuable than coal having a higher ash content. Consequently, various methods and apparatus have been used to separate coal from the intermixed ash. As noted above, in the early days of mining, the separation was performed by hand grading. However, with the increasing quantities and reduced purity of coal being graded it became necessary to convert to automated systems for beneficiating coal ores.

Coal and ash have slightly differing densities, coal being generally less dense than ash. Consequently, flotation systems, based upon Archimedes Principle, have commonly been used for such separation. Plain water, the least expensive liquid medium for flotation, is not satisfactory as a medium, however, because both coal and ash are substantially more dense than water and therefore both sink in plain water. However, it is the average density of the liquid media which determines which material will float. The average density of water-based media have been increased heretofore by the addition of finely divided materials, such as clay. In turn the added material must be recovered from the media prior to reuse or discharge for economic, as well as environmental, reasons. The prior systems have suffered the disadvantage of requiring substantial quantities of fresh water and extensive purification systems, such as settling ponds, in order to remove the densifying material.

Another problem is that in some cases there is very little difference between the density of the coal and the density of the ash being removed. Consequently, flotation separation becomes quite difficult.

Heretofore efforts have been made to employ rotating barrels with helical flights for improved beneficiation of coal. A mixture of a liquid medium and the ore is deposited within the rotating barrel. Coal floats within the medium and the ash sinks. Helical flights within the barrel screw the ash upwardly out of the barrel while the coal floats out the bottom of the barrel with the medium. These efforts have not been altogether successful, however, because they have not proven adaptable to the varying conditions encountered in the field. From one gob pile to another and even within a single gob pile, extreme variations exist in the types of materials and relative amounts of different types of materials. These extreme variations require quite different operating conditions for optimum beneficiation. Prior efforts to beneficiate coal ore with barrels have not adequately provided for such variations. The prior barrel systems have required a major shutdown and alteration to adapt prior machines to new ore mixtures. The costs of such shutdowns have made it uneconomical to beneficiate gob piles, particularly smaller gob piles.

Coal fines, i.e., coal particles which pass through screens having openings $\frac{1}{4}$ inch by $\frac{1}{4}$ inch, frequently comprise a large percentage of the coal content of gob piles. Also, if a coal seam contains a high ash content, it is necessary to crush the coal to smaller sizes to release the ash contained within the coal. As a result, substantial amounts of coal fines are available for recovery, yet prior systems have failed to efficiently recover coal fines. Instead, the fines are generally disposed along with the ash. It has been particularly troublesome that prior benefication and grading systems have not permitted the economic recovery of the coal in gob piles, which amounts to an estimated three billion tons of coal usable for steam generation or industrial purposes. Instead, despite the growing requirements for energy, the gob piles have continued to accumulate both in number and size.

Accordingly, it is therefore an object of the present invention to provide an apparatus for beneficiating coal. It is a further object to provide an apparatus for beneficiating coal which requires a minimal amount of fresh water and efficiently recovers coal fines from a wide variety of mixtures of coal and ash. Other objects and advantages of the invention will become apparent from the following description, particularly when taken with reference to the drawings in which.

Generally in accordance with the present invention, an elongated barrel and feeding system therefor are provided for the beneficiation of a mixture of coal and a second material, as from gob piles. The elongated, axially sloping barrel includes an interior surface carrying ribbon flights, an exterior surface, a first end and a second end. Means are provided for varying the speed at which the barrel is rotated, for varying the slope of the axis of the barrel, for depositing the mixture at variable locations within the barrel, and for depositing the liquid medium at variable locations within the barrel.

By controlling the angle of the slope of the axis of the barrel, the rate of rotation of the barrel, and the location of deposit of the ore material and the medium, in combination with the density of the medium, varying coal mixtures can be separated in a continuous fashion at peak efficiency. As a result, a heretofore unattainable level of coal fine recovery has been achieved.

Figure 1:
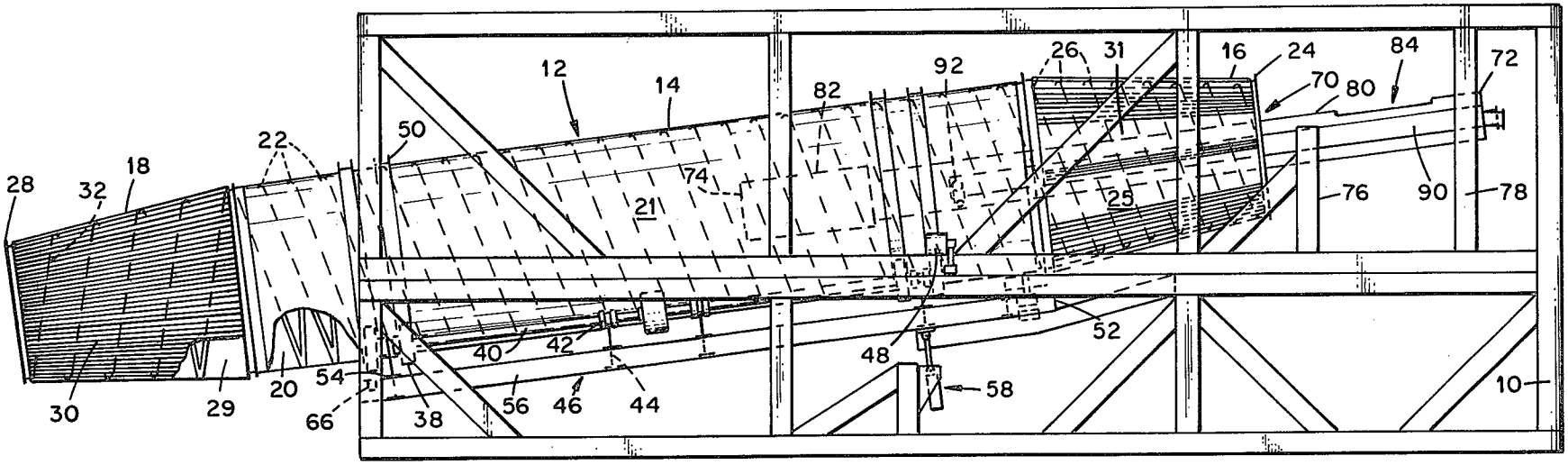
FIG. 1 is an elevational view of an apparatus embodying various of the features of the present invention.
Figure 2:
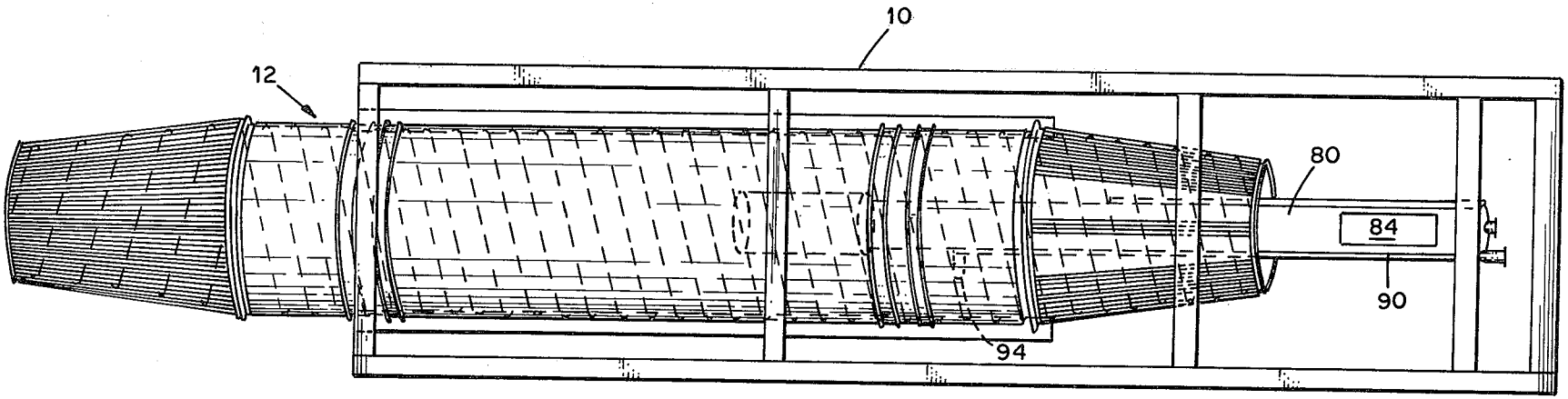
FIG. 2 is a plan view of the apparatus depicted in FIG. 1.
Figure 3:
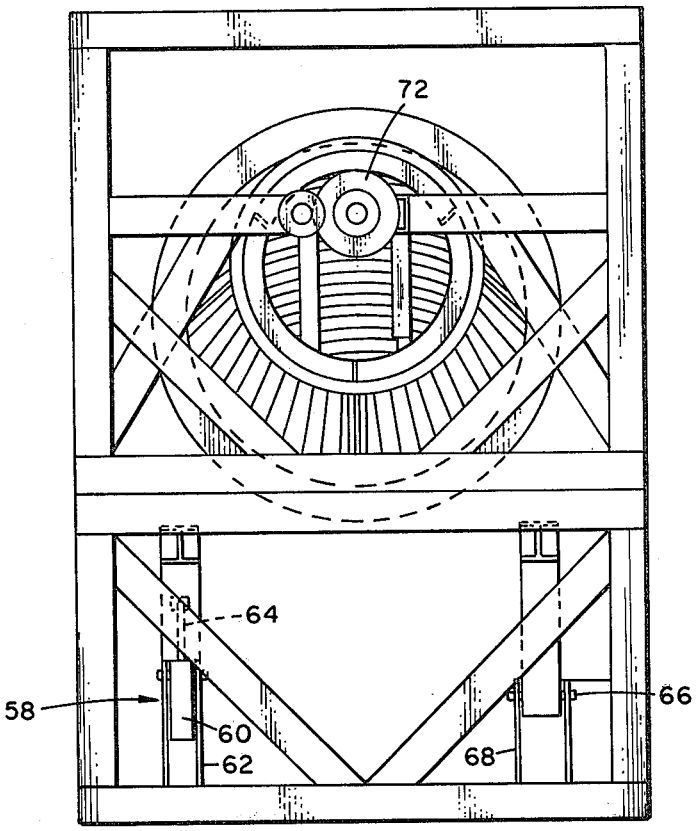
FIG. 3 is a right side elevational view of the apparatus depicted in FIG. 1.

Referring more particularly to the drawings, the FIGS. 1–3, there is depicted an apparatus embodying various of the features of the present invention. A fabricated support framework 10 of standard construction is provided. A barrel 12 is mounted within the framework for axial rotation. The barrel 12 is oriented at an acute angle to the horizontal.

The barrel 12 includes a cylindrical central section 14, a coaxial, foraminous first end section 16 and a coaxial foraminous second end section 18. The first end section 16 and second end section 18 are frustoconical in shape, each end section being secured at its base to the central section 14. The internal surfaces of the barrel 12 carry spiral ribbon flights which, upon rotation of the barrel, screw settled ash material upwardly and out of the liquid medium, through the central section 14 and first end section 16. Simultaneously, coal and the medium are gravity-drawn downwardly into the second end section 18 and screwed out by the reverse flights of the second end 18 section.

The central section 14, in which the ore material and medium are initially deposited and the primary separation is accomplished, is six feet in diameter and twenty-five feet long. It is constructed of an imperforate sheet having an interior surface 20 and an exterior surface 21. Three spiral flights 22 are mounted upon the interior surface of the central section 14, as by welding. The flights 22 carry ash, which sinks in the medium, upwardly toward the first end 24 of the barrel 12. Each flight 22 extends from the first end section 16 to the second end section 18. The three flights 22 are spaced about the circumference of the central section 14 at intervals of 120° and longitudinally spaced apart at intervals of one foot. That is, each flight 22 completes a 360° spiral over an axial distance of three feet. Each flight 22 is oriented perpendicular to the interior wall 20 of the central section 14 and extends radially inwardly from the central section 14 by a distance of four inches.

The first end section 16 comprises a perforated screen material and is frustoconical in shape. The section 16 is seven feet long, having a base diameter of six feet, the same diameter as the central section 14, and a diameter of four feet at the first end 24 of the barrel 12. The internal surface 25 of the first end section 16 carries three spiral flights 26, each being a continuation of one of the flights 22 mounted within the central section 14. The flights 26 are four inches in height and each completes one spiral revolution of the section 16 over an axial distance of three feet. The flights are circumferentially spaced at 120° intervals and axially spaced apart at one foot intervals. Each of the flights 26 terminates at the first end 24 of the barrel 12. From this point the discharged ash is removed for drying and disposal, as will be discussed more fully hereinafter.

The second end section 18, the lowermost section of the barrel 12, also comprises a perforated screen material and is frustoconical in shape. The section 18 is seven feet long, having a base diameter of six feet, at the junction with the central section 12, and a diameter of four feet at the second end 28 of the barrel 12.

The first end section 16 and the second end section 18 each comprise a perforated screen material defining openings which are one-half inch in diameter at the inner surfaces of the end sections. However, it has been found that the openings may range from about $\frac{1}{8}$ inch to about $\frac{3}{4}$ inch. The openings taper outwardly toward the outer surfaces 30 to prevent particles from becoming lodged in the screen openings. Thus, as the medium carries coal downwardly from the sloping central section 14, the medium passes through the openings of the end section 18, along with coal particles which are carried therethrough. In the first end section 16, the medium carried by the ash and flights 26 drains through the openings defined therein.

In order to urge the larger coal particles from the second end section 18, a spiral flight 32 is mounted upon the internal surface 29 of the second end section 18. The flight 32 begins at the termination of one of the flights 22 of the central section 14, but spirals in a direction opposite to the spiral direction of the flights 22. The flight 32 is four inches in height and completes a 360° revolution of the section 18 over an axial distance of three feet. The flight 32 terminates at the second end 28 of the barrel 12, where the coal is deposited upon a screen 34 (FIG. 4) for rinsing and dewatering. The reverse spiral of the flight 32 provides the result that while the flights 22 and 26 screw the more dense ash material upwardly through the barrel 12, the flight 32, rotating in the same direction as the flights 22 and 26, screws coal material in the opposite direction, downwardly through the end 28 of the barrel 12.

The barrel 12 is mounted for rotation at variable speeds at an axial angle of about 7° within the framework 10. Means are provided for varying the axial slope of the barrel 12 during rotation from about 5.5° to about 8.5° in accordance with the content of the ore material being treated. The barrel 12 rests directly upon a plurality of cylindrical rollers 38 which are coaxially mounted upon a pair of parallel, spaced apart shafts 40. The shafts 40 are journalled in bearings 42 carried by lateral beams 44 of an adjustable platform 46. One of the shafts 40 is driven by a conventional electric motor 48 at an adjustable rate whereby the barrel 12 is rotatable at between about 2 rpm and about 35 rpm. Channels 50 are defined upon the outer surface 22 of the central section 14. The rollers 38 ride within the channels 50 to prevent axial shifting of the barrel 12.

The platform 46, including a first end 52 and a second end 54, comprises two longitudinal beams 56 and a plurality of lateral beams 44 spaced apart over the lengths of the longitudinal beams 56. The platform 46 which carries the barrel 12, is hingedly mounted upon the framework 10 to permit adjustment of the angle of slope of the axis of the barrel 12.

The first end 52 of the platform 46 is supported by two hydraulic linear actuators 58, each of which includes a cylinder 60 pivotally secured to a support member 62 of the framework 10, and a longitudinally extendible piston member 64 pivotally secured to the platform 46. The second end 54 of the platform 46 is pivotally attached with pins 66 to two yokes 68 mounted upon the framework 10. Extension and retraction of the piston members 64, causes the platform 46 to pivot upwardly and downwardly, respectively, about an axis defined by the pins 66 at the second end 54 of the platform 46. In this manner the relative heights of the first end 24 and second end 28 of the barrel 12 are adjustable and the angle of slope of the axis of the barrel 12 is adjustable on a continuous basis between about 5° and about 8.5° from horizontal in accordance with the content of the ore material being treated.

In order to supply ore material and liquid medium to the interior of the barrel 12, a cylindrical conduit 70 having an infeed end 72 and a discharge end 74 extends from a location outside the first end 24 of the barrel 12 into the barrel. The conduit 70 extends through the end section 16 to locate the discharge end 74 at a point approximately nineteen feet from the first end 24 of the barrel 12, measured along the axis of the barrel. The conduit 70 is about eighteen inches in diameter and about twenty-four feet in length. The conduit 70 is supported by brackets 76 and 78 secured to the framework 10 exteriorly of the barrel 12 so that the conduit 70 is cantilevered into the barrel. The conduit 70 comprises a first section 80 and a telescoping section 82. The section 82 is longitudinally adjustable relative to the section 80. In this manner, the location of discharge of the ore and medium mixture is axially adjustable within the barrel 12 in accordance with the content of the ore material being treated.

Figure 4A:
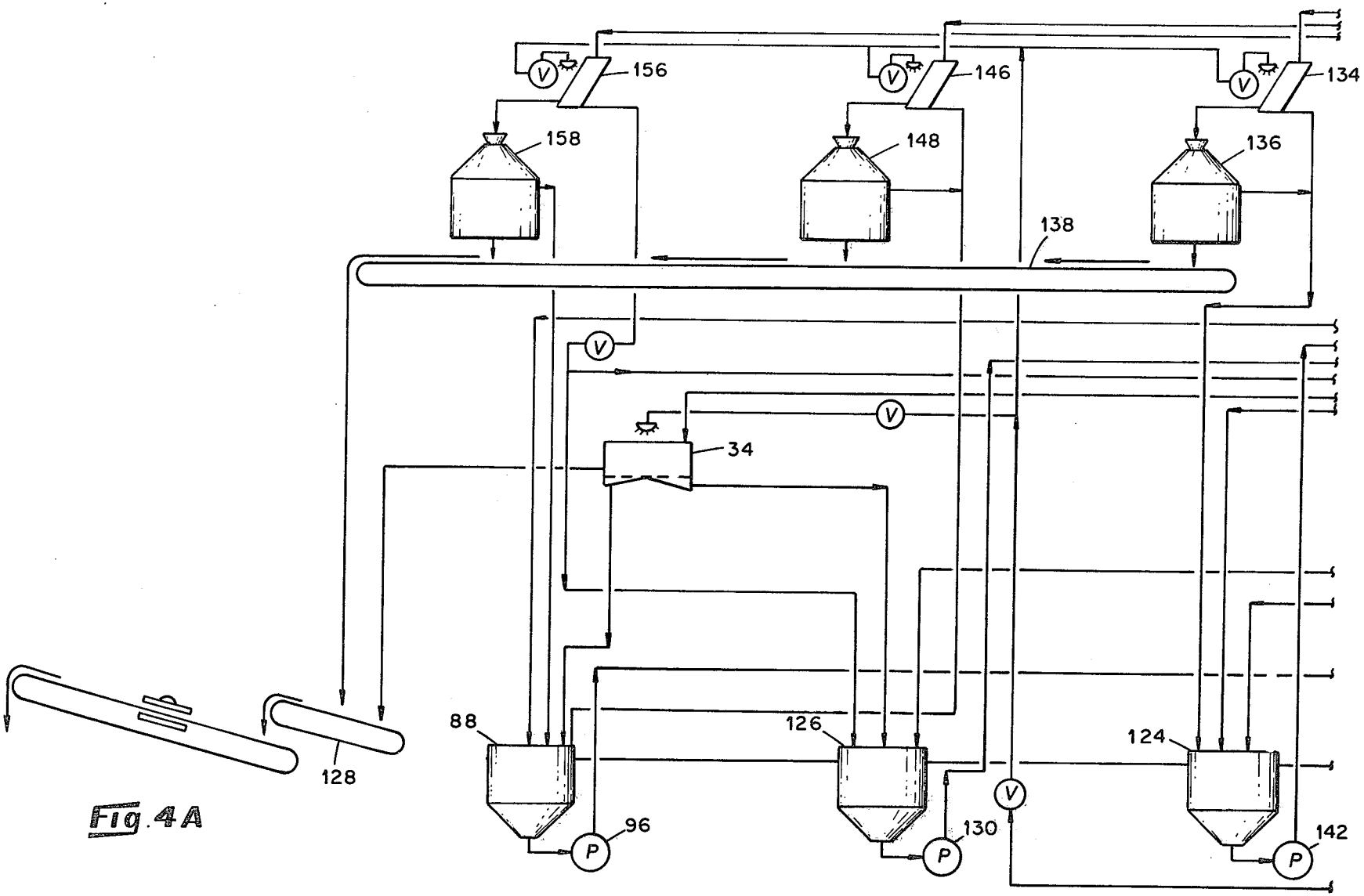
FIGS. 4A and 4B are a schematic diagram of a coal beneficiating system adapted for the use of the apparatus of the present invention.
Figure 4B:
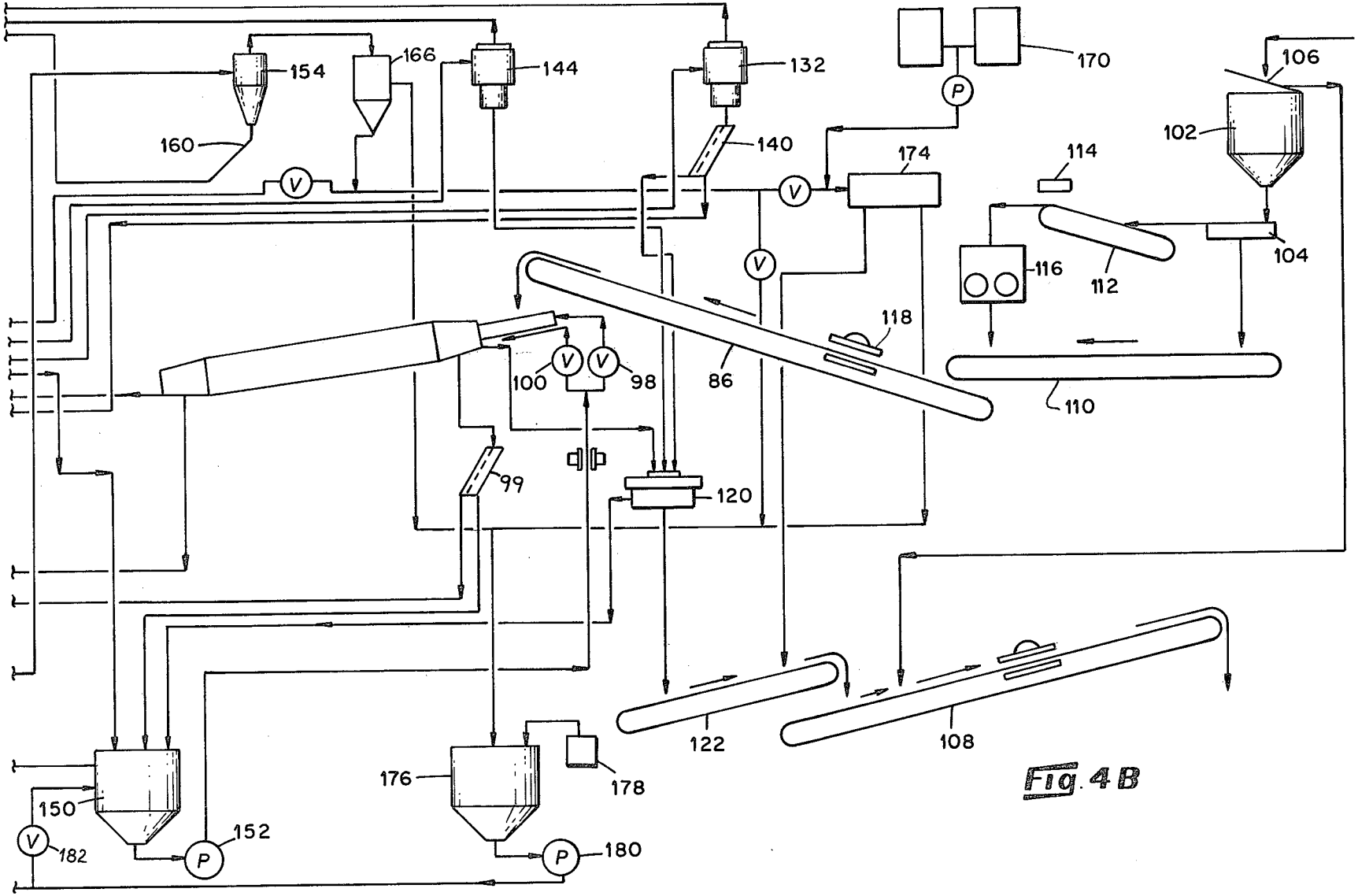

A feed aperture 84 is defined in the wall of the conduit 70 exteriorly of the barrel 12. The aperture 84 is oriented upwardly so that ore material is deposited into the conduit upon discharge from the end of a raw feed conveyor 86 (FIG. 4).

A liquid flotation medium, collected in a media tank 150 (FIG. 4), is deposited within the barrel 12 at two locations. The medium is added to the ore material at a location adjacent to the opening 84. In the depicted embodiment, the medium is added to the conduit 70 at the infeed end 72, behind the opening 84. The medium added at this location flushes the ore down the sloping conduit 70 to the discharge end 74 of the conduit 70 and into the central section 14 of the barrel.

Medium is also added to the barrel 12 through a secondary conduit 90 at a location between the discharge end 74 of the conduit 70 and the first end 24 of the barrel. That is, the secondary conduit 90 extends from a location outside the barrel 12 to a location above the discharge end 74 of the conduit 70. The interior end 92 of the secondary conduit 90 terminates in a radially extending portion 94. The conduit 90 is slidably mounted upon the conduit 70 so that the portion 94 of the secondary conduit 90 is longitudinally adjustable relative to the conduit 70. Thus, the axial location at which the radially injected medium first enters the barrel 12 is adjustable. As a result, the medium entering the barrel 12 through the media conduit 90 runs countercurrent to the ore material being screwed upwardly through the barrel 12 by the flights 22. This radially injected medium flushes entrapped coal from the mass of material carried by the flights 22.

The conduit 70 and media conduit 90 are both supplied with medium by the slurry pump 180, pumping out of the media tank 150. A first media valve 98 and a second media valve 100 control media flow through the conduit 70 and the media conduit 90, respectively. Thus, the relative amounts of medium supplied at the two locations are adjustable.

When the barrel is in operation, raw ore material enters the barrel through the conduit 70. Within the conduit 70, a portion of the medium, having a specific gravity of about 1.2 to about 1.65, is added to and mixed with the raw ore material. The particular specific gravity of the medium depends upon the specific content of the ore material being separated. This mixture is continuously added to the central section 14 of the barrel 12 where the liquid medium suspends the coal contained in the mixture sufficiently to carry it into the second end section 18. In contrast, the ash settles upon the interior surface of the central section 14 and is then screwed up and out of the barrel 12.

For easily separated coal and ash, i.e., where there is a well defined difference in specific gravity, the barrel 12 is rotated at a rate of about 15.75 r.p.m. and the piston rods 64 are extended to orient the barrel axis at an angle of about 7.86° from horizontal. Under these operating conditions, the dwell time of material within the barrel 12 is quite short. On the other hand, for difficult to separate mixtures, the dwell time is increased by reducing the rotation of the barrel to a rate as low as about 10.2 r.p.m. and retracting the rods 64 to reduce the slope of the barrel axis to an angle as low as about 5.2° from horizontal. The precise angle and rate of rotation are determined in accordance with the particular ore mixture being separated.

A schematic flow diagram for a coal washing plant adapted for supplying and receiving the discharged material from the system of the present invention is shown in FIG. 4. Raw material, such as from a bituminous gob pile is dumped into a surge hopper 102 for continuous loading onto a feeder 104. A grizzly 106 mounted upon the hopper 102 prevents oversize material, such as over four inch material, from entering the system. The oversize reject material is deposited upon a reject conveyor 108 for disposal.

The feeder 104 divides the incoming mixture with a 2 inch by 2 inch screen. Material which passes the feeder screen is deposited on a sizing conveyor 110. Material which does not pass the feeder screen is carried over a picking table 112 and past a magnet 114 to remove debris, then fed through a crusher 116 and onto the sizing conveyor 110.

From the sizing conveyor 110, the mixture is deposited upon a raw feed conveyor 86 which includes a belt scale 118 for constantly monitoring the rate at which raw feed is provided to the barrel 12. A suitable control circuit (not shown) is provided to interconnect the belt scale 118 with the surge hopper 102 whereby the flow of material through the surge hopper 102 is adjusted accordingly when the rate of raw feed varies from a predetermined level, such as 150 tons per hour. The raw feed material is deposited through the opening 84 into the conduit 70 and then flushed into the barrel 12.

As discussed hereinabove, course reject material which sinks in the medium contained in the barrel 12 is screwed upwardly over the screened first end section 16. The ¼" by 0 material passing through the screened first end section 16 is deposited upon a 28 mesh screen 99. The ¼" by 28 mesh material retained upon the screen 99 is deposited in a fines/solids slurry tank 124. The 28 mesh by 0 material passing through the screen 99 is deposited in the media tank 150. The large reject material is then processed through a vibratory centrifuge 120, such as model VC-48 available from Centrifugal and Mechanical Industries, Inc., of St. Louis, Missouri. From the centrifuge 120 the course reject is deposited upon a reject blending conveyor 122, then onto the reject conveyor 108 for disposal. The liquid separated from the coarse reject material by the centrifuge 120 is directed to the media tank 150 where it is collected along with the liquid and 28 mesh by 0 material passing through the screen for further treatment to be described more fully hereinafter.

The recovered product material which is carried out of the central section 14 by the medium is screwed out of the barrel 12 and over the screened second end section 18 by the flight 32. The ½ inch by 0 product material passing through the second end section openings is directed into a solids slurry tank 126 where it is collected for separation treatment, as will be described more fully hereinafter.

The 2" by ½" product material which does not pass through the openings of the second end section 18 is deposited upon a vibrating dewatering and rinse screen 34. The initial material passing through the screen 34, containing ¼" by 0 product, is directed into the solids slurry tank 126 where it is collected for separation treatment. While the 2" by ½" product is retained on the screen 34 it is rinsed with make-up water, a mixture of fresh water and clarified water previously used in the system. The rinsing make-up water, which carries 28 mesh by 0 product is directed to a classifying slurry tank 88 where it is collected for use in the barrel 12 as described hereinabove.

The rinsed 2" by ½" coal is transferred from the screen 34 to a clean coal blending conveyor 128, where it is blended with ½" by 100 mesh coal separated elsewhere in the system.

The slurry contained in the solids slurry tank 126 is pumped by a slurry pump 130 to a first stage cyclone 132. The cyclone 132 separates ½" by 0 product material from ½" by 0 reject material. The ½" by 0 product material, the overflow from the cyclone 132 is rinsed with make-up water and dewatered on a screen 134 defining openings which are ¼" in diameter. The screen 134 is oriented at an angle of about 60° from horizontal so that the screen 134 retains ½" by ⅛" product, which is dried in a continuous centrifugal dryer 136, such as Model EB-36 available from Centrifugal and Mechanical Industries, Inc., of St. Louis, Missouri. The dried ½" by ⅛" clean coal is deposited upon a clean coal conveyor 138, which in turn deposits the coal onto the clean coal blending conveyor 128. The slurry removed from the ½" by ⅛" coal by the centrifuge 136 is directed to the fines/solids slurry tank 124, along with the slurry and ⅛ by 0 product passing through the screen 134.

The underflow from the first stage cyclone 132 is deposited upon a screen 140 defining openings which are ⅛" in diameter. The screen 140 is oriented at an angle of about 60° with horizontal so that a slurry carrying 1 millimeter by 0 product passes through the screen 140 and is directed to the fines/solids slurry tank 124. The ½" by 1 millimeter reject retained on the screen 140 is directed to the centrifuge 120 for drying and disposal along with the large reject from the barrel 12.

The slurry contained in the fines/solids slurry tank 124 is pumped by a slurry pump 142 to a second stage cyclone 144. The cyclone 144 generally separates ¼" by 0 product material from ¼" by 0 reject material. The ¼" by 0 product material, the overflow from the cyclone 144, is rinsed with make-up water and dewatered on a screen 146. The screen is oriented at an angle of about 60° from horizontal so that the screen 146 retains ¼" by 28 mesh product, which is dried in a continuous centrifugal dryer 148 such as Model EB-36 available from Centrifugal and Mechanical Industries, Inc. The dried ⅛" by 28 mesh clean coal is deposited upon the clean coal conveyor 138, which in turn deposits the coal onto the clean coal blending conveyor 128. The slurry removed from the ½" by 28 mesh coal by the centrifuge 148 is directed to the classification slurry tank 88, along with the slurry and 28 mesh by 0 product passing through the screen 146.

The slurry contained in the classification slurry tank 88 is pumped by a slurry pump 96 to a classifying cyclone 154. The overflow from the cyclone 154, is deposited in a head water tank 166. Slurry removed from the tank 166 is returned to the make-up water tank 176. The underflow from the classifying cyclone 154, which carries 28 mesh by 0 fines is directed through conduit 160, then rinsed with make-up water and dewatered on a mesh screen 156. The screen 156 is oriented at an angle of about 60° with horizontal so that 28 mesh by 100 mesh coal is retained on the screen 156. The retained material is dried in a continuous centrifugal dryer 158 in which 100 mesh by 0 coal is removed with the liquid and returned to the classifying slurry tank 88. The clean 28 mesh by 100 mesh coal is dposited upon the clean coal conveyor 138 and then the clean coal blending conveyor 128.

The 100 mesh by 0 product passing through the screen 156 is split into two portions and directed to the solids slurry tank 126 and the media tank 150.

As desired, the material drawn from the bottom of the tank 166 is mixed with a standard flocculent pumped from a flocculent dosing unit 170 by a pump 172, then the mixture is fed to a clarifying centrifuge 174, such as Model HB2500 available from the Bird Machine Company, Inc., of South Walpole, Massachusetts. The reject solids exiting from the clarifying centrifuge 174 are deposited on the reject blending conveyor 122 and then onto the reject conveyor 108. The clarified water exiting from the centrifuge 174 is directed to the make-up water tank 176, where it is mixed with water from a fresh water source 178.

Make-up water is pumped from the make-up water tank 176 to the media tank 150 by a pump 180. A valve 180 controls the flow of make-up water to the media slurry tank and the screens 34, 134, 146 and 156.

The density of the medium added to the barrel 12 is adjusted in accordance with the content of the ore material being treated. The medium is adjusted while it is stored in the tank 150 through selective adjustment of the valve 182, controlling make-up water flow to the media tank 150.

A system in accordance with the present invention permits the beneficiation of varying mixtures of coal and ash on a substantially continuous basis. The system does not require a shutdown when varying concentrations of coal are located within a single gob pile. Moreover, the efficiency of the beneficiation is improved whereby there is less use of water and a diminished requirement for settling ponds.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. An apparatus for the beneficiation of a mixture including coal and a second material having a greater density than coal comprising:

a frame, an elongated, hollow, generally cylindrical barrel member, said barrel member including:

an imperforate central section, a foraminous inwardly directed, frustoconical end section connected to each end of said central section, a spiral flight attached to the interior surface of the central section of said barrel and at least one of said frustoconical sections, means for mounting said barrel for rotation on said frame with its longitudinal axis disposed at an acute angle to the horizontal with a frustoconical section having a spiral flight being elevated relative to the other frustoconical section, means for varying the angle of said barrel, means for rotating said barrel about its longitudinal axis, a source of liquid medium of predetermined density, a source of said mixture, means for depositing said liquid medium from said medium source at a location within said central section, means for continuously supplying said mixture to a location within said central section, whereby coal concentrate passes out the lower end of said barrel and the second material passes out the upper end of said barrel.

2. An apparatus as defined in claim 1 wherein said means for varying the angle of said barrel comprises elongated platform means having a first end and a second end, said barrel member being supported by said platform means, said platform means being pivotally attached to said frame at said first end and vertically adjustable means attaching said second end of said platform to said frame.

3. An apparatus as defined in claim 1 and further comprising means for varying the point of deposition of said medium to various positions longitudinally of said central section.

4. An apparatus as defined in claim 3 wherein said liquid medium supplying means comprises a media conduit slidingly mounted within said barrel, adjacent to the axis of said barrel.

5. An apparatus as defined in claim 4 wherein said media conduit terminates in a radially extending portion within said central section of said barrel.

6. An apparatus as defined in claim 1 and further comprising means for combining said medium with said mixture and varying the point of deposition of said combination to various positions longitudinally of said central section.

7. An apparatus as defined in claim 6 wherein said combination supplying means comprises a conduit axially mounted within said barrel and further comprises a first section and a telescoping second section.

8. A method of beneficiating a mixture including coal and a second material having a greater density than said coal, comprising the steps of depositing said mixture and a liquid medium of predetermined density into an elongated, axially sloping barrel having an internal surface carrying a spiral flight, an exterior surface, in imperforate central section, a foraminous frustoconical first end section and foraminous frustoconical second end section, rotating said barrel to repeatedly agitate said mixture and medium, whereby substantially all of said coal and said medium are carried downwardly into said second end section and said second material is screwed upwardly through said first end section by said spiral flight, the improvement comprising combining said mixture with said medium prior to deposit in said barrel and depositing a secondary portion of liquid medium into said barrel at a location within said central section and above the location at which said combination of mixture and medium are deposited within said barrel, thereby flushing entrapped coal from said flight means and said second material.

9. The method as defined in claim 8 wherein said secondary portion of medium is deposited into said second section in a direction generally counter to the direction of rotation of said barrel.

10. A method of beneficiating a mixture including coal and a second material having a greater density than said coal, comprising depositing said mixture and a liquid medium of predetermined density into an elongated, axially sloping barrel having in internal surface carrying a spiral flight, an exterior surface, an imperforate central section, a foraminous frustoconical first end section and a foraminous frustoconical second end section, rotating said barrel to repeatedly agitate said mixture and medium, whereby said coal and said medium are carried downwardly into said second end section and said second material is screwed upwardly through said first end section, the improvement comprising combining said mixture with said medium prior to deposit in said barrel and adjusting the dwell time of said coal, said second material and said medium within said barrel in accordance with the difference in density, between said coal and said second material, by adjusting the slope of said barrel and adjusting the rate of rotation of said barrel.

11. A method of beneficiating a mixture including coal and a second material having a greater density than said coal, comprising depositing said mixture and a liquid medium of predetermined density into an elongated, axially sloping barrel having an internal surface carrying a spiral flight, an exterior surface, an imperforate central section, a foraminous frustoconical first end section and a foraminous frustoconical second end section, rotating said barrel to repeatedly agitate said mixture and medium, whereby coal and said medium are carried downwardly into said second end section and said second material is screwed upwardly through said first end section, the improvement comprising combining said mixture with said medium prior to deposit in said barrel and longitudinally adjusting the location at which the combination of the mixture and media is deposited within the central section of the barrel in accordance with the contents of the mixture.

* * * * *